US009290982B2

(12) United States Patent
Schuetz et al.

(10) Patent No.: US 9,290,982 B2
(45) Date of Patent: Mar. 22, 2016

(54) METHOD FOR ACTUATING A CLOSURE ELEMENT ARRANGEMENT OF A MOTOR VEHICLE

(71) Applicant: Brose Fahrzeugteile GmbH & Co. KG, Hallstadt, Hallstadt (DE)

(72) Inventors: Axel Schuetz, Naisa (DE); Christian Weidenbacher, Donnersdorf (DE); Rainer Wunsch, Ebensfeld (DE)

(73) Assignee: Brose Fahrzeugteile GmbH & Co. KG, Hallstadt, Hallstadt (DE)

( * ) Notice: Subject to any disclaimer, the term of this patent is extended or adjusted under 35 U.S.C. 154(b) by 0 days.

(21) Appl. No.: 14/535,495

(22) Filed: Nov. 7, 2014

(65) Prior Publication Data

US 2015/0128497 A1 May 14, 2015

(30) Foreign Application Priority Data

Nov. 7, 2013 (DE) ..... 10 2013 018 593

(51) Int. Cl.
*E06B 3/00* (2006.01)
*E05F 15/73* (2015.01)
*E05F 15/611* (2015.01)

(52) U.S. Cl.
CPC ..... *E05F 15/73* (2015.01); *E05F 15/611* (2015.01)

(58) Field of Classification Search
CPC ..... E05F 15/70; B60J 5/00
USPC ..... 49/506, 25, 31; 296/56, 146.4, 146.8; 318/283, 286, 266, 466, 468
See application file for complete search history.

(56) References Cited

U.S. PATENT DOCUMENTS

| | | | | |
|---|---|---|---|---|
| 4,595,331 | A * | 6/1986 | Thompson et al. | 414/347 |
| 5,531,498 | A * | 7/1996 | Kowall | 296/146.4 |
| 6,719,356 | B2 * | 4/2004 | Cleland et al. | 296/146.8 |
| 8,284,022 | B2 | 10/2012 | Kachouh | |
| 8,534,743 | B2 * | 9/2013 | Scheler | 296/146.8 |

(Continued)

FOREIGN PATENT DOCUMENTS

DE 10110493 9/2002

OTHER PUBLICATIONS

German Search Report, DE Application No. 1020130185939, priority application of this application, U.S. Appl. No. 14/535,945 dated Oct. 29, 2014, 8 pages.

*Primary Examiner* — Jerry Redman
(74) *Attorney, Agent, or Firm* — Pauly, Devries Smith & Deffner, LLC

(57) ABSTRACT

The invention relates to a method for actuating a closure element arrangement of a motor vehicle, wherein the closure element arrangement comprises a control arrangement and an operator-control-event sensor arrangement with at least one operator-control-event sensor element which is configured, in particular, as a proximity sensor, wherein within the scope of operator-control-event monitoring by means of the control arrangement the sensor measured values of the operator-control-event sensor arrangement are monitored to determine whether a predetermined operator control event is occurring, and the closure element arrangement is actuated as a function of the result of the operator-control-event monitoring. It is proposed that externally activated lifting of the motor vehicle is detected by means of the control arrangement, and the actuability of the closure element arrangement which is due to an operator control event is deactivated when a special condition due to the lifting of the motor vehicle occurs.

17 Claims, 2 Drawing Sheets

(56) References Cited

U.S. PATENT DOCUMENTS

2005/0004723 A1* 1/2005 Duggan et al. ..... 701/24
2010/0211283 A1* 8/2010 Harrison et al. ..... 701/72
2013/0221626 A1* 8/2013 Lee ..... 280/5.514
2014/0195073 A1 7/2014 Herthan
2014/0236446 A1* 8/2014 Spence ..... 701/70
2014/0277993 A1* 9/2014 Hookway et al. ..... 701/101

* cited by examiner

METHOD FOR ACTUATING A CLOSURE ELEMENT ARRANGEMENT OF A MOTOR VEHICLE

CROSS-REFERENCE TO RELATED APPLICATIONS

This application claims priority from German Patent Application Serial No. DE 10 2013 018 593.9, entitled "Verfahren zur Ansteuerung einer Verschlusselementanordnung eines Kraftfahrzeugs," filed Nov. 7, 2013, the disclosure of which is hereby incorporated by reference herein in its entirety.

FIELD OF THE TECHNOLOGY

The invention relates to a method for actuating a closure element arrangement of a motor vehicle and to a control arrangement for carrying out such a method.

BACKGROUND

Contemporary motor vehicles are increasingly equipped with closure elements which can be activated by motor. Such closure elements can be, for example, doors such as side doors and rear doors, in particular sliding doors, flaps, in particular tailgates, boot lids, engine bonnets, luggage compartment floors or the like of a motor vehicle. In this respect, the term "closure element" is to be understood in a wide sense here.

A comfort function which is accorded increasing significance nowadays is the automatic activation of the motor-driven tailgate of a motor vehicle. In the known method (EP 1 808 820 A1), on which the invention is based, there is provision that an operator-side operator control event, here an operator-side foot movement, brings about the motor-driven opening of the tailgate.

The known method uses a control arrangement and a sensor arrangement, wherein within the scope of operator-control-event monitoring by means of the control arrangement the sensor measured values of the sensor arrangement are monitored to determine whether a predetermined operator control event is occurring.

The sensor arrangement has two capacitive sensors which extend over the entire width of the motor vehicle. An operator control event, here an operator-side foot movement, can be easily detected electronically.

While the known method provides a considerable increase in comfort for the operator, problems regarding the operational safety may occur, in particular, during the maintenance of the motor vehicle. The case on which the emphasis is here is that the motor vehicle is raised under external control within the scope of the maintenance or repair. For example, the motor vehicle is lifted in the workshop by means of a lifting platform so that maintenance or repair work can be carried out underneath the motor vehicle.

If the person who is entrusted with carrying out maintenance or repair carries on their person the radio key which is usually necessary for authentication, the situation can occur in which the control arrangement detects a movement of this person as an operator control event when the motor vehicle is lifted. The consequence is motor-driven opening of the tailgate, which as a result of the lifting height of the motor vehicle can in the most unfavourable case lead to a collision of the tailgate with parts of the building, in particular the ceiling of the workshop. To this extent, the operational safety with the known method is limited.

The invention is based on the object of configuring and developing the known method in such a way that the operational safety is increased.

SUMMARY

The above problem is solved in a method described herein.

The essential basic idea is to deactivate the actuability of the closure element arrangement which is due to an operator control event when a special condition due to the externally activated lifting of the motor vehicle occurs. This makes it possible to ensure, in particular, that the operator-control-event monitoring in the case of a motor vehicle positioned on a lifting platform or the like does not bring about an, in particular, motor-driven activation of the closure element arrangement.

The method according to the proposal reduces the risk of unintended, in particular motor-driven, opening of the closure element of the closure element arrangement to a minimum. However, at the same time there is still the possibility of, in particular, motor-driven adjustment of the closure element by means of remote control by radio or the like.

The term "deactivation of the actuability which is due to an operator control event" is to be understood in a wide fashion here, which is explained below on the basis of a closure element arrangement with a drive arrangement for the motor-driven adjustment of the closure element.

The deactivation of the actuability of the closure element arrangement which is due to an operator control event can be implemented, for example, by virtue of the fact that the operator-control-event monitoring is itself deactivated. As a result, the detection of an operator control event by sensor is ruled out from the outset. However, it is also conceivable that the operator-control-event monitoring continues to operate, while a driver for a drive motor of the closure element arrangement is deactivated. Although an operator control event is then detected as such by sensor, motor-driven adjustment of the closure element does not occur. Finally, it is conceivable that the operator-control-event monitoring is modified in such a way that an operator control event is no longer detected as such, with the result that the motor-driven adjustment of the closure element also fails to occur here. Correspondingly, deactivation according to the proposal can be implemented in quite different ways in the sense of the above, wide interpretation.

Some embodiments relate to different special conditions which are due to the lifting of the motor vehicle. In an embodiment, the special condition is the reaching of a predetermined lifting height of the motor vehicle. According to an example, the lifting of the motor vehicle is detected in that the wheels of the motor vehicle are freely suspended.

In an embodiment, a sensor arrangement having at least one sensor element for detecting the special condition is provided. Numerous variants are conceivable for the configuration of the sensor arrangement. Various embodiments, relate to the use of the sensors which are present in any case for detecting the occurrence of the respective special condition. As a result, the expenditure on the implementation of the solution according to the proposal can be reduced.

In accordance with a further embodiment, the control arrangement for carrying out the method according to the proposal is described herein. Reference may be made to all statements which are suitable for explaining the control arrangement.

In an embodiment, a method for actuating a closure element arrangement of a motor vehicle, wherein the closure element arrangement comprises a control arrangement and an operator-control-event sensor arrangement with at least one operator-control-event sensor element which is configured, in particular, as a proximity sensor, wherein within the scope of operator-control-event monitoring by means of the control arrangement the sensor measured values of the operator-control-event sensor arrangement are monitored to determine whether a predetermined operator control event is occurring, and the closure element arrangement is actuated as a function of the result of the operator-control-event monitoring, wherein externally activated lifting of the motor vehicle is detected by means of the control arrangement, and the actuability of the closure element arrangement which is due to an operator control event is deactivated when a special condition due to the lifting of the motor vehicle occurs, is provided.

In an embodiment, the closure element arrangement comprises a drive arrangement which is assigned to the closure element, and the drive arrangement is actuated as a function of the result of the operator-control-event monitoring.

In an embodiment, the special condition is the reaching of a predetermined lifting height of the motor vehicle, in particular by means of a lifting platform or the like, such as the special condition is the exceeding of a predetermined lifting height of the motor vehicle compared to a vehicle underlying surface.

In an embodiment, the special condition is the free suspension of the wheels of the motor vehicle as a result of lifting of the motor vehicle.

In an embodiment, a special-condition sensor arrangement with at least one special-condition sensor element is provided for sensing the occurrence of the special condition, and in that the special-condition sensor arrangement is checked for the occurrence of the special condition by means of the control arrangement, such as the special-condition sensor arrangement additionally serves for the closed-loop control of the driving mode.

In an embodiment, the special-condition sensor arrangement has a special-condition sensor element which is configured as a ride level sensor which is assigned to the chassis of the motor vehicle, and in that the control arrangement monitors the ride level sensor for the occurrence of the special condition, such as the ride level sensor also serves to carry out motor-driven alignment of a lighting system of the motor vehicle.

In an embodiment, the special-condition sensor arrangement comprises a special-condition sensor element which is configured as an electronic stability sensor, and the special-condition sensor arrangement monitors the electronic stability sensor for the occurrence of the special condition. One type of electronic stability sensor that can be used is a sensor compatible with the Electronic Stability Programme (ESP®) provided by Daimler AG Corporation.

In an embodiment, the special-condition sensor arrangement comprises a special-condition sensor element, configured as a position sensor and/or as an acceleration sensor, for a motor vehicle alarm system, and the special-condition sensor arrangement monitors the position sensor for the occurrence of the special condition.

In an embodiment, the special-condition sensor arrangement comprises a special-condition sensor element which is configured as a tire-pressure-measuring means, and the special-condition sensor arrangement monitors the tire-pressure-measuring means for the occurrence of the predetermined special condition.

In an embodiment, at least one operator control event is defined as an operator movement, such as at least one operator control event is defined as a foot movement by the operator, alternatively the operator-control-event sensor arrangement comprises at least one operator-control-event sensor element which is configured as a proximity sensor. In an embodiment, at least one operator control event is defined as a forward movement and return movement of the operator's foot, so that, in some cases, during the operator control event the at least one operator-control-event sensor element generates a pulse-like time profile of the sensor measured values.

In an embodiment, a control arrangement for carrying out a method as described herein is provided.

BRIEF DESCRIPTION OF THE FIGURES

In the text which follows, the invention is explained in more detail on the basis of a drawing which is illustrating only one exemplary embodiment. In the drawing.

DETAILED DESCRIPTION

The method according to the proposal is explained in the text which follows on the basis of a closure element arrangement 1 of a motor vehicle, which closure element arrangement 1 comprises a closure element 2 which is configured as a tailgate. In various embodiments, the configuration of the closure element 2 is a tailgate of a motor vehicle. However, in view of the wide understanding of the term "closure element," reference may be made here to the introductory part of the description. To this extent, all the statements regarding a tailgate apply correspondingly to all other types of closure elements.

Figure 1:
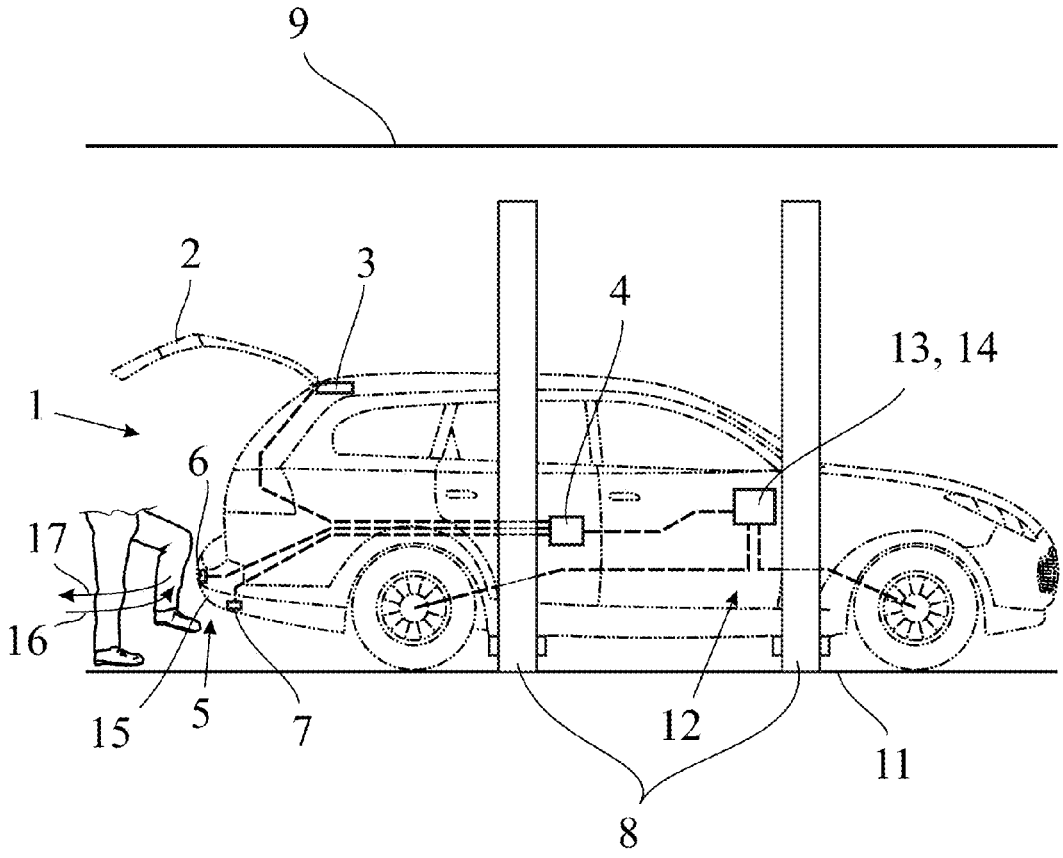
FIG. 1 shows a motor vehicle for carrying out the method according to the proposal on a lifting platform in the non-lifted state.
Figure 2:
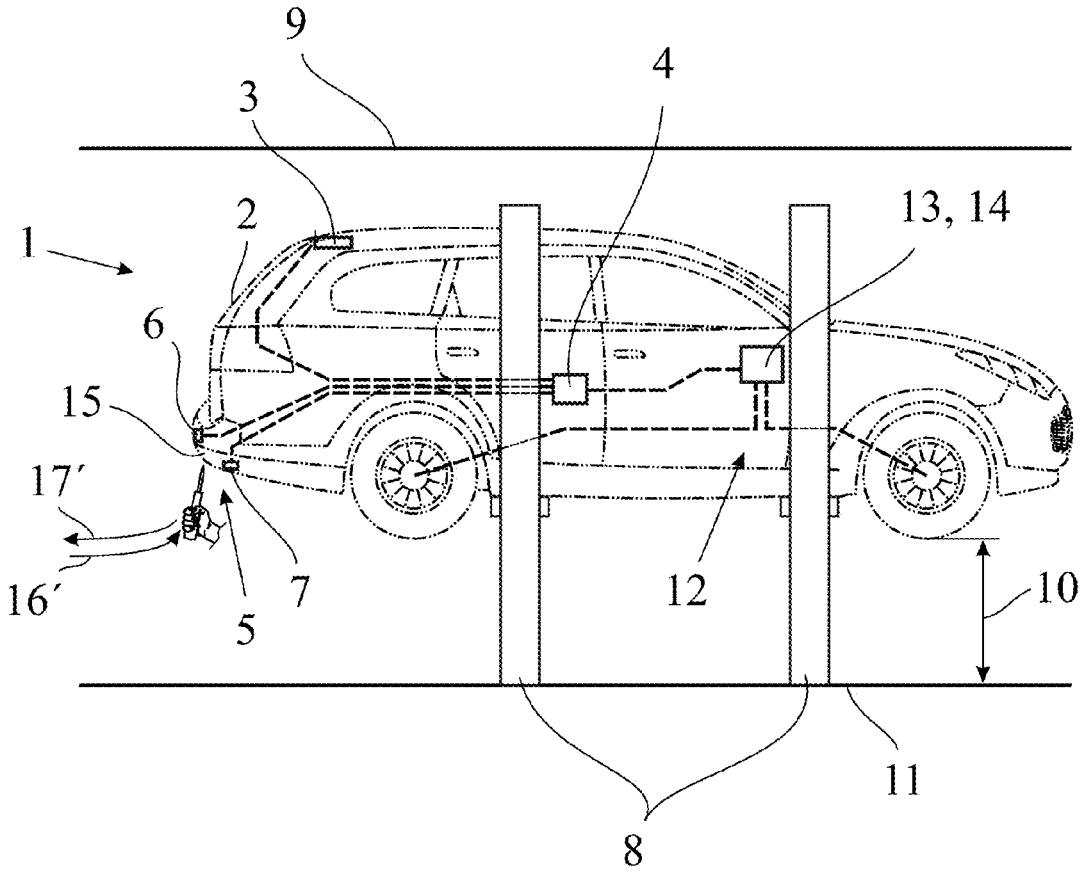
FIG. 2 shows the motor vehicle according to FIG. 1 in the lifted state.

The tailgate 2 is assigned a drive arrangement 3 by means of which an adjustment of the tailgate 2 between the closed position illustrated in FIG. 2 and the open position illustrated in FIG. 1 can be brought about. The drive arrangement 3 can be a motor-driven drive arrangement which can also have an electric drive motor and an advancing mechanism which is connected downstream. In an embodiment, the drive arrangement 3 comprises two spindle drives which act on the two lateral regions of the tailgate 2. Basically it is, however, also conceivable for the drive arrangement 3 to be spring-driven and to act correspondingly in a single direction, such as in the opening direction.

In addition, a control arrangement 4 is provided which serves, inter alia, for actuating the closure element arrangement 1 and, here, in particular, the drive arrangement 3. An operator-control-event sensor arrangement 5 having at least one operator-control-event sensor element 6, 7 which is configured, in particular, as a proximity sensor communicates with the control arrangement 4. The operator-control-event sensor arrangement 5 which is to be explained below is configured in such a way that it can be used to detect operator movements by sensor. Instead of or in addition to a proximity sensor, the operator-control-event sensor arrangement 5 with the at least one operator-control-event sensor element 6, 7 can also comprise a camera or a radar sensor arrangement, for example for a gesture detection means.

In the illustrated embodiment, the control arrangement 4 has a central hardware structure. However, it is also conceivable for the control arrangement 4 to have a decentralized hardware structure. In this case, part of the control hardware can be accommodated in the operator-control-event sensor arrangement 5. This means that the operator-control-event sensor arrangement 5 has its own intelligence which can serve, for example, for signal preprocessing.

Certain operator movements are defined here as operator control events which are each intended to trigger a certain reaction of the control arrangement 4. The operator control event can be a foot movement of the operator, which will be explained below.

In order to be able to react to the occurrence of operator control events as mentioned above, operator-control-event monitoring is provided, which is carried out by the control arrangement 4. Within the scope of the operator-control-event monitoring, the sensor measured values of the operator-control-event sensor arrangement 5 are monitored by means of the control arrangement 4 to determine whether or not a predetermined operator control event occurs. The sensor events can be any desired deviations of the sensor measured values from the open-circuit sensor measured values. The open-circuit sensor measured values are present if the sensor arrangement is not experiencing any external effect by an operator or the like. Corresponding actuation of the closure element arrangement 1, here the drive arrangement 3, is carried out as a function of the result of the operator-control-event monitoring. Specifically, the drive arrangement 3 can be actuated, for example, for the motor-driven opening of the tailgate 2.

It is essential to the solution according to the invention that externally activated lifting of the motor vehicle is detected by means of the control arrangement 4, and that the actuability of the closure element arrangement 1, here the drive arrangement 3, which is due to an operator control event is deactivated when a special condition due to the lifting of the motor vehicle occurs. This means that the occurrence of an operator control event, for example as a result of a corresponding operator movement, does not lead to the usual actuation of the closure element arrangement 1, here of the drive arrangement 3, if the special condition which is due to the lifting of the motor vehicle has occurred.

Externally activated lifting of the motor vehicle in the above sense is shown by a combination of FIGS. 1 and 2. The drawing shows a workshop situation in which the lifting of the motor vehicle can be carried out by means of a lifting platform 8. FIG. 2 shows that in the lifted state of the motor vehicle opening of the tailgate 2 would lead to a collision of the tailgate 2 with the workshop ceiling 9. Here, the solution according to the proposal comes in in that the actuability which is due to an operator control event is deactivated when the above special condition occurs.

It has already been pointed out that the deactivation can be carried out by switching off the operator-control-event monitoring itself or else by switching off a driver for the drive arrangement 3. Other variants for the deactivation, according to the proposal, of the actuation, due to an operator control event, of the closure element arrangement 1 are conceivable.

In an embodiment, the special condition according to the proposal is the reaching of a predetermined lifting height 10 of the motor vehicle, wherein the lifting of the motor vehicle to the lifting height 10 is carried out by means of a lifting platform 8, mentioned above, or the like. The term "lifting height" is to be understood in a wide fashion here. It basically comprises a vertical distance of the motor vehicle from any reference point. The lifting height of a motor vehicle here can refer to the height of the motor vehicle with respect to a vehicle underlying surface 11.

Depending on the method of lifting the motor vehicle, in particular depending on the configuration of the lifting platform 8 or the like, when the motor vehicle is lifted, the wheels of the motor vehicle are freely suspended as a result of the lifting of the motor vehicle. This is the case with the lifting platform 8 illustrated in the drawing. Owing to gravity, the wheels of the motor vehicle are offset slightly downward in relation to the motor vehicle at other times, in particular in relation to the bodywork of the motor vehicle, compared with the normal operating state of the motor vehicle. This offset provides the information that there is some probability that the motor vehicle is located on a lifting platform 8. Correspondingly, the special condition in some variations is the free suspension of the wheels of the motor vehicle caused by lifting of the motor vehicle, and said free suspension can easily be detected by sensor.

A special-condition sensor arrangement 12 with at least one special-condition sensor element 13 can be provided for detecting the occurrence of the special condition, wherein the special-condition sensor arrangement 12 is checked for the occurrence of the special condition by means of the control arrangement 4.

In an embodiment, the special-condition sensor arrangement 12 serves not only to detect the occurrence of the special condition but also for the closed-loop control of the driving mode. In particular, during the driving mode the special-condition sensor arrangement 12 can supply actual values for individual variables such as the vehicle ride level, rotational speed of the individual wheels of the motor vehicle, a spring travel of the wheels of the motor vehicle or the like.

The above information is transmitted from the special-condition sensor arrangement 12 to the control arrangement 4, for example, via a telecommunications bus, which can be, in particular, a CAN (Controller Area Network) bus.

The special-condition sensor arrangement 12 is equipped here with a special-condition sensor element 13, which is configured as a ride level sensor 14 which is assigned to the chassis of the motor vehicle, wherein the control arrangement 4 monitors the ride level sensor 14 for the occurrence of the special condition. Such a ride level sensor 14 makes available the offset of the wheels of the motor vehicle in the vertical direction in relation to the motor vehicle at other times. As a result, the free suspension of the wheels of the motor vehicle which is mentioned above and is caused by lifting of the motor vehicle can be detected in a particularly easy way.

A ride level sensor 14 as above is generally used in the motor-driven alignment of a lighting system of the motor vehicle. In an embodiment, a ride level sensor 14 is provided which serves both for carrying out the motor-driven alignment of the lighting system and for detecting the occurrence of the above special condition. This double use of the ride level sensor 14 gives rise to a particularly cost-effective implementation of the solution according to the proposal.

An embodiment of the double use of a sensor arrangement is that the special-condition sensor arrangement 12 comprises a special-condition sensor element 13 which is configured as an electronic stability sensor such as an ESP® (Electronic Stability Programme) sensor, wherein the special-condition sensor arrangement 12 monitors the sensor 13 for the occurrence of the special condition. In particular, the special-condition sensor element 13 can be a sensor which determines the spring compression travel of the wheels of the motor vehicle as mentioned above.

A further embodiment, which is also due to a double use of a sensor arrangement comprises the fact that the special-condition sensor arrangement 12 comprises a special-condition sensor element 13, configured as a position sensor and/or as an acceleration sensor, for a motor vehicle alarm system, wherein the special-condition sensor arrangement 12 monitors the position sensor for the occurrence of the special condition.

Another double use of a sensor arrangement is obtained by virtue of the fact that the special-condition sensor arrangement 12 comprises a special-condition sensor element 13 which is configured as a tire-pressure-measuring means, wherein the special-condition sensor arrangement 12 monitors the tire-pressure-measuring means for the occurrence of the predetermined special condition. This is due to the realization that the respective, externally activated lifting of the motor vehicle is fundamentally associated with a change in the tire pressure of the wheels of the motor vehicle.

The sensor arrangement 5 is of elongate configuration here. The sensor arrangement 5 can have at least two sensor sections, each of which is assigned an at least horizontally offset detection region. In this context, each sensor section can correspond to one sensor element 6, 7. The at least two sensor sections can be actuated separately from one another by means of the control arrangement 4. In the simplest case, this means that the individual sensor sections can be read out individually. It is essential to the last-mentioned variant that the at least two sensor sections are actuated individually within the scope of the operator-control-event monitoring, in groups or together as a function of the positional information.

At least one operator control event can be defined as an operator movement, wherein at least one operator control event can also be a foot movement of the operator. As mentioned further above, the operator-control-event sensor arrangement 5 comprises at least one operator-control-event sensor element 6, 7 which is configured as a proximity sensor and is arranged in or on a rear trim component, in particular the rear bumper 15, of a motor vehicle, and which can extend over a significant part of the width of the motor vehicle.

The at least one operator control event can be defined as a forward and return movement 16, 17 of the operator's foot, wherein during the operator control event the at least one operator-control-event sensor element 6, 7 here generates a pulse-like time profile of the sensor measured values. The forward movement 16 and the return movement 17 are merely indicated in FIG. 1.

It is easy to imagine that an above forward movement 16 with subsequent return movement 17 can readily occur inadvertently within the scope of the maintenance or repair of the motor vehicle, with the result that incorrect actuation of the drive arrangement 3 can occur. This is indicated by the forward movement 16' and the return movement 17' in FIG. 2. To this extent, the solution according to the proposal involves a considerable increase in the operational safety. An above incorrect actuation of the drive arrangement 3 within the scope of maintenance or repair can largely be avoided.

Basically, different special conditions can be defined which require a different reaction on the part of the control arrangement 4. Depending on the detected special condition, it is possible to provide, for example, that the deactivation of the actuation of the closure element arrangement 1 is carried out either for individual, predetermined operator control events or for all the predetermined operator control events.

According to a further teaching, which is also accorded independent significance, the above control arrangement 4 for carrying out a method according to the proposal is claimed as such. Reference can be made to all the statements relating to the method according to the proposal which are suitable for explaining the control arrangement 4 as such.

What is claimed is:

1. A method for actuating a closure element arrangement of a motor vehicle, wherein the closure element arrangement comprises a control arrangement and an operator-control-event sensor arrangement with at least one operator-control-event sensor element configured as a proximity sensor, the method comprising:

monitoring for operator control events with the control arrangement, comprising monitoring sensor measured values from the operator-control-event sensor arrangement to determine whether a predetermined operator control event is occurring, wherein the closure element arrangement is actuated based on the monitoring for operator control events;

detecting an occurrence of a special condition comprising an externally activated lifting of the motor vehicle with the control arrangement; and deactivating actuation of the closure element arrangement due to an operator control event when the special condition occurs.

2. The method according to claim 1, wherein the closure element arrangement comprises a drive arrangement which is assigned to the closure element, and wherein the drive arrangement is actuated based on the operator-control-event monitoring.

3. The method according to claim 1, wherein the special condition comprises reaching a predetermined lifting height of the motor vehicle with a lifting platform.

4. The method according to claim 3, wherein the special condition comprises exceeding the predetermined lifting height of the motor vehicle compared to a vehicle underlying surface.

5. The method according to claim 1, wherein the special condition comprises a free suspension of the wheels of the motor vehicle as a result of the lifting of the motor vehicle.

6. The method according to claim 1, wherein a special-condition sensor arrangement with at least one special-condition sensor element is provided for sensing the occurrence of the special condition, and wherein the special-condition sensor arrangement is checked for the occurrence of the special condition by the control arrangement.

7. The method according to claim 6, wherein the special-condition sensor arrangement serves for closed-loop control of a driving mode.

8. The method according to claim 6, wherein the special-condition sensor arrangement has a special-condition sensor element configured as a ride level sensor assigned to a chassis of the motor vehicle, and wherein the control arrangement monitors the ride level sensor for the occurrence of the special condition.

9. The method according to claim 8, wherein the ride level sensor serves to carry out motor-driven alignment of a lighting system of the motor vehicle.

10. The method according to claim 6, wherein the special-condition sensor arrangement comprises a special-condition sensor element which is configured as an electronic stability sensor, and wherein the special-condition sensor arrangement monitors the electronic stability sensor for the occurrence of the special condition.

11. The method according to claim 6, wherein the special-condition sensor arrangement comprises a special-condition sensor element configured as at least one of a position sensor and an acceleration sensor, for a motor vehicle alarm system, and wherein the special-condition sensor arrangement monitors the at least one of the position sensor and the acceleration sensor for the occurrence of the special condition.

12. The method according to claim 6, wherein the special-condition sensor arrangement comprises a special-condition sensor element configured as a tire-pressure-measuring means, and wherein the special-condition sensor arrangement monitors the tire-pressure-measuring means for the occurrence of the special condition.

13. The method according to claim 1, wherein the operator control event comprises an operator movement.

14. The method according to claim 13, wherein the operator control event is defined as a foot movement by the operator.

15. The method according to claim 14, wherein the operator control event is defined as a forward foot movement and return foot movement by the operator.

16. The method according to claim 13, wherein the sensor measured values generated by the at least one operator-control-event sensor element have a pulse shape with respect to time corresponding to the operator control event.

17. A control arrangement, comprising control hardware configured to carry out the method according to claim 1.

* * * * *